US012385487B2

(12) United States Patent
Lin et al.

(10) Patent No.: US 12,385,487 B2
(45) Date of Patent: Aug. 12, 2025

(54) TWO-STAGE REFRIGERANT COMPRESSOR AND OPERATION METHOD THEREOF

(71) Applicant: FU SHENG INDUSTRIAL CO., LTD., Taipei (TW)

(72) Inventors: Wei-Hsu Lin, Taipei (TW); Yao-Chung Liu, Taipei (TW)

(73) Assignee: FU SHENG INDUSTRIAL CO., LTD., Taipei (TW)

( * ) Notice: Subject to any disclaimer, the term of this patent is extended or adjusted under 35 U.S.C. 154(b) by 0 days.

(21) Appl. No.: 18/661,959

(22) Filed: May 13, 2024

(65) Prior Publication Data

US 2024/0418169 A1 Dec. 19, 2024

(30) Foreign Application Priority Data

Jun. 17, 2023 (TW) ..... 112122807

(51) Int. Cl.

| | |
|---|---|
| ***F04C 18/16*** | (2006.01) |
| ***F04C 23/00*** | (2006.01) |
| ***F04C 28/02*** | (2006.01) |
| ***F04C 28/08*** | (2006.01) |
| ***F04C 28/12*** | (2006.01) |
| ***F04C 28/24*** | (2006.01) |

(52) U.S. Cl.

CPC ..... *F04C 18/16* (2013.01); *F04C 23/001* (2013.01); *F04C 28/02* (2013.01); *F04C 28/08* (2013.01); *F04C 28/12* (2013.01); *F04C 28/24* (2013.01)

(58) Field of Classification Search

CPC ..... F04C 18/16; F04C 23/001; F04C 28/02; F04C 28/08; F04C 28/12; F04C 28/24

See application file for complete search history.

(56) References Cited

U.S. PATENT DOCUMENTS

| | | | | |
|---|---|---|---|---|
| 12,140,143 | B1 * | 11/2024 | Liu | F04C 23/001 |
| 2020/0080559 | A1 * | 3/2020 | Liu | F04C 23/001 |
| 2021/0102554 | A1 * | 4/2021 | De Bontridder | F04C 28/02 |

OTHER PUBLICATIONS

Foreign Patent Publication and Machine Translation for CN 115523149 A; 1st Inventor: Zhong; Title: A Double-Stage Compressor for Improving the Radiating Performance of Motor; Published: Dec. 27, 2022. (Year: 2022).*

* cited by examiner

*Primary Examiner* — Mary A Davis

(74) *Attorney, Agent, or Firm* — Chun-Ming Shih; hdls ipr services

(57) ABSTRACT

A two-stage refrigerant compressor and an operation method thereof are disclosed. The two-stage refrigerant compressor (10) includes: a housing (1); a first compressor module (2) having first screw rods (21) and a first motor (22) driving the first screw rods (21) to rotate; a second compressor module (3) having second screw rods (31) and a second motor (32) driving the second screw rods (31) to rotate; an adjustment mechanism (4) having a first slide valve (41) and a second slide valve (42); a middle pressure sensor (51) configured to acquire a current middle pressure; and a processor configured to receive data of the current middle pressure, control rotating speeds of the first motor (22) and the second motor (32), and control locations of the first slide valve (41) and the second slide valve (42).

17 Claims, 10 Drawing Sheets

TWO-STAGE REFRIGERANT COMPRESSOR AND OPERATION METHOD THEREOF

BACKGROUND OF THE DISCLOSURE

Technical Field

The present disclosure relates to a compressor device, especially to a two-stage refrigerant compressor and an operation method thereof.

Description of Related Art

A related-art two-stage refrigerant compressor has a first housing in which a first compressing room disposed with a first stage rotor, a second housing in which a second compressing room disposed with a second stage rotor, and an external pipeline communicating the first compressing room and the second compressing room. A fluid (for example a refrigerant or a cooling liquid) is firstly compressed by the first stage rotor and then compressed by the second stage rotor, and the fluid subsequently communicates with the first compressing room, the external pipeline and the second compressing room to make a fluid pressure in the first compressing room, a fluid pressure in a middle chamber and a fluid pressure in the second compressing be divided into a low pressure, a middle pressure and a high pressure.

However, the structure of the external pipeline affects an air discharge pressure of the first stage rotor to decrease, and the middle pressure of the external pipeline, an air discharge pressure/an air discharge amount of the first stage rotor and an air suction pressure/an air suction amount of the second stage rotor are related and interactively affect each other. Under situations of the two-stage refrigerant compressor being used in different operating conditions, the air discharge pressure/the air discharge amount of the first stage rotor and the air suction pressure/the air suction amount of the second stage rotor are different. As such, if the middle pressure of the external pipeline, the air discharge pressure/the air discharge amount of the first stage rotor and the air suction pressure/the air suction amount of the second stage rotor may be all within a controllable and adjustable range, the two-stage refrigerant compressor may be in an operating mode with a best efficiency.

Accordingly, the applicant of the present disclosure has devoted himself for improving the mentioned shortages.

SUMMARY OF THE DISCLOSURE

The present disclosure is to provide a two-stage refrigerant compressor and an operation method thereof, in which all factors possibly affecting performances in a single housing are within a controllable range, thus the two-stage refrigerant compressor is in an operating mode with a best efficiency.

Accordingly, the present disclosure provides a two-stage refrigerant compressor includes: a housing having an inner space thereof divided into an air suction channel, a first compressing room, an electric machine room, a second compressing room and an air discharge channel sequentially disposed and mutually communicating with each other; a first compressor module, including a pair of first screw rods disposed in the first compressing room and mutually engaged, and a first motor disposed in the electric machine room and configured to drive one of the first screw rods to rotate, wherein a first contact line is defined by the pair of first screw rods; a second compressor module, including a pair of second screw rods disposed in the second compressing room and mutually engaged, and a second motor disposed in the electric machine room and configured to drive one of the second screw rods to rotate, wherein a second contact line is defined by the pair of second screw rods; an adjustment mechanism, including a first slide valve moveably disposed corresponding to the first contact line and a second slide valve moveably disposed corresponding to the second contact line; a pressure sensing set, including a middle pressure sensor disposed in the electric machine room to acquire a current middle pressure, and a processor, connected to the first motor, the second motor, the first slide valve, the second slide valve, the middle pressure sensor, and configured to receive data of the current middle pressure, control a rotating speed of the first motor and a rotating speed of the second motor and control a location of the first slide valve and a location of second slide valve; wherein, the pressure sensing set further includes an air suction pressure sensor and an air discharge pressure sensor, the air suction pressure sensor is disposed in the air suction channel to acquire an air suction pressure, the air discharge pressure sensor is disposed in the air discharge channel to acquire an air discharge pressure, the processor is connected to the air suction pressure sensor and the air discharge pressure sensor, and the processor is configured to receive data of the air suction pressure and the air discharge pressure.

Accordingly, the present disclosure provides an operation method of a two-stage refrigerant compressor includes a) providing the foresaid two-stage refrigerant compressor, the first motor driving one of the first screw rods to rotate with a frequency conversion manner, and the second motor driving one of the second screw rods to rotate with the frequency conversion manner; b) obtaining a current temperature and setting a preset temperature, and a controller adjusting or keeping a rotating speed of the first motor according to a value acquired by subtracting the preset temperature from the current temperature; c) calculating a set middle pressure, and the controller adjusting or keeping a rotating speed of the second motor according to a value acquired by subtracting the set middle pressure from a current middle pressure; and d) calculating a lower pressure specific volume of the first compressing room, a middle pressure specific volume of the electric machine room and a high pressure specific volume of the second compressing room, and the controller adjusting or keeping a location of the first slide valve according to a value acquired by dividing the low pressure specific volume by the middle pressure specific volume, and adjusting or keeping a location of the second slide valve according to a value acquired by dividing the middle pressure specific volume by the high pressure specific volume.

Accordingly, the present disclosure provides an operation method of a two-stage refrigerant compressor includes steps of: e) providing the foresaid two-stage refrigerant compressor, the first motor driving one of the first screw rods to rotate with a fixed frequency manner, and the second motor driving one of the second screw rods to rotate with the frequency conversion manner; f) obtaining a current temperature and setting a preset temperature, and a controller adjusting or keeping a location of the first slide valve according to a value acquired by subtracting the preset temperature from the current temperature; g) calculating a set middle pressure, and the controller adjusting or keeping a rotating speed of the second motor according to a value acquired by subtracting the set middle pressure from a current middle pressure; and h) calculating a lower pressure specific volume of the first compressing room, a middle pressure specific volume of the electric machine room and a high pressure specific volume of the second compressing room, and the controller adjusting or keeping the location of the first slide valve according to a value acquired by dividing the low pressure specific volume by the middle pressure specific volume, and adjusting or keeping a location of the second slide valve according to a value acquired by dividing the middle pressure specific volume by the high pressure specific volume.

Advantages achieved by the present disclosure are as follows. An adjustable compression ratio is achieved by the rotating speed of the first screw rod and the rotating speed of the second screw rod, an adjustable volume ratio is achieved by controlling the location of the first slide valve and the location of the second slide valve, thus all possible factors affecting the performance of the two-stage refrigerant compressor are all within a controllable range, and the two-stage refrigerant compressor is provided with an advantages of being in an operation mode with a desirable efficiency under variable operating conditions.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

Figure 1:
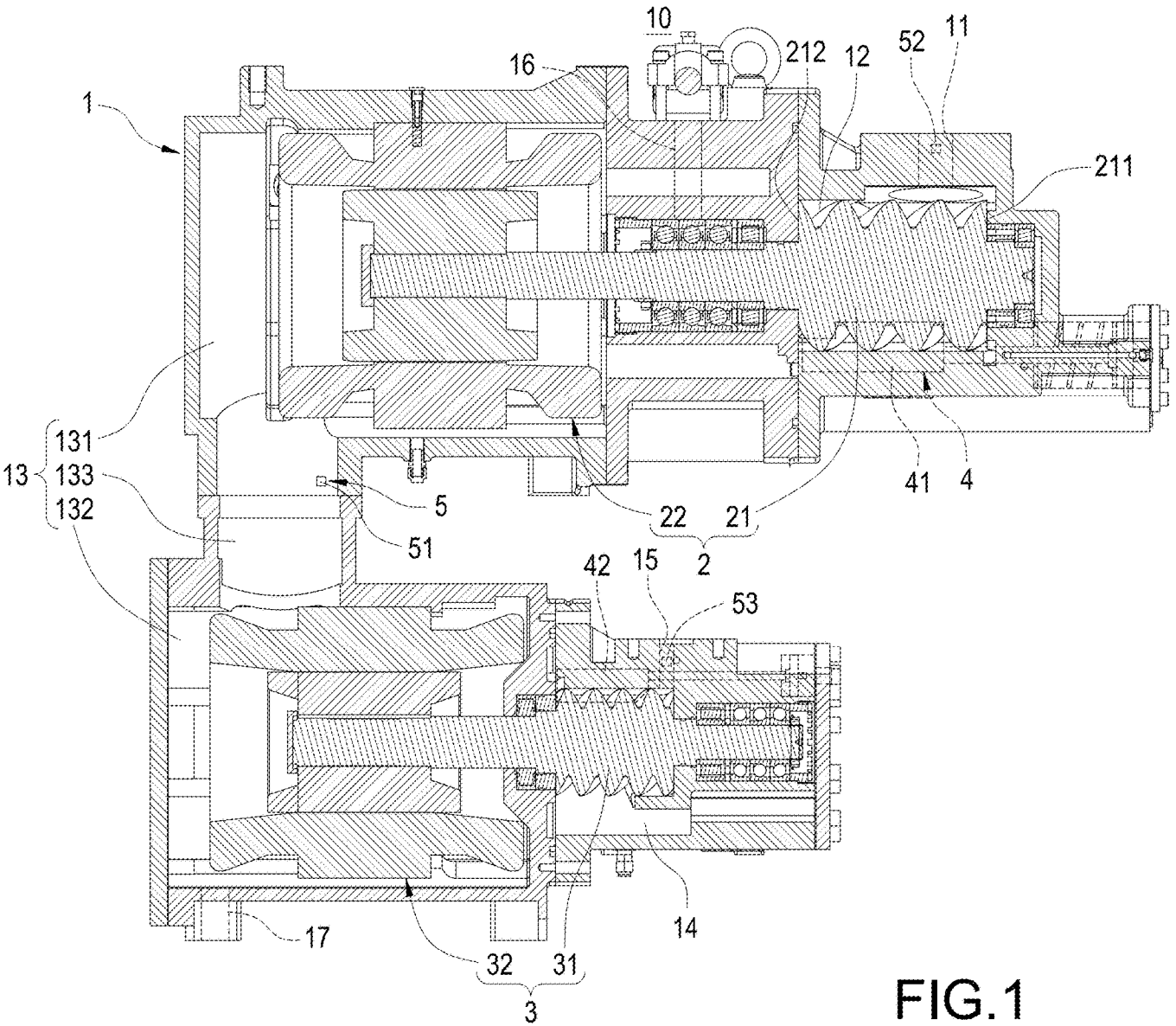
FIG. 1 is a cross sectional view showing the two-stage refrigerant compressor according the first embodiment of the present disclosure.

The technical contents of this disclosure will become apparent with the detailed description of embodiments accompanied with the illustration of related drawings as follows. It is intended that the embodiments and drawings disclosed herein are to be considered illustrative rather than restrictive.

Please refer from FIG. 1 to FIG. 10, the present disclosure provides a two-stage refrigerant compressor and an operation method thereof. The two-stage refrigerant compressor 10 mainly includes a housing 1, a first compressor module 2, a second compressor module 3, an adjustment mechanism 4, a pressure sensing set 5 and a processor.

Figure 2:
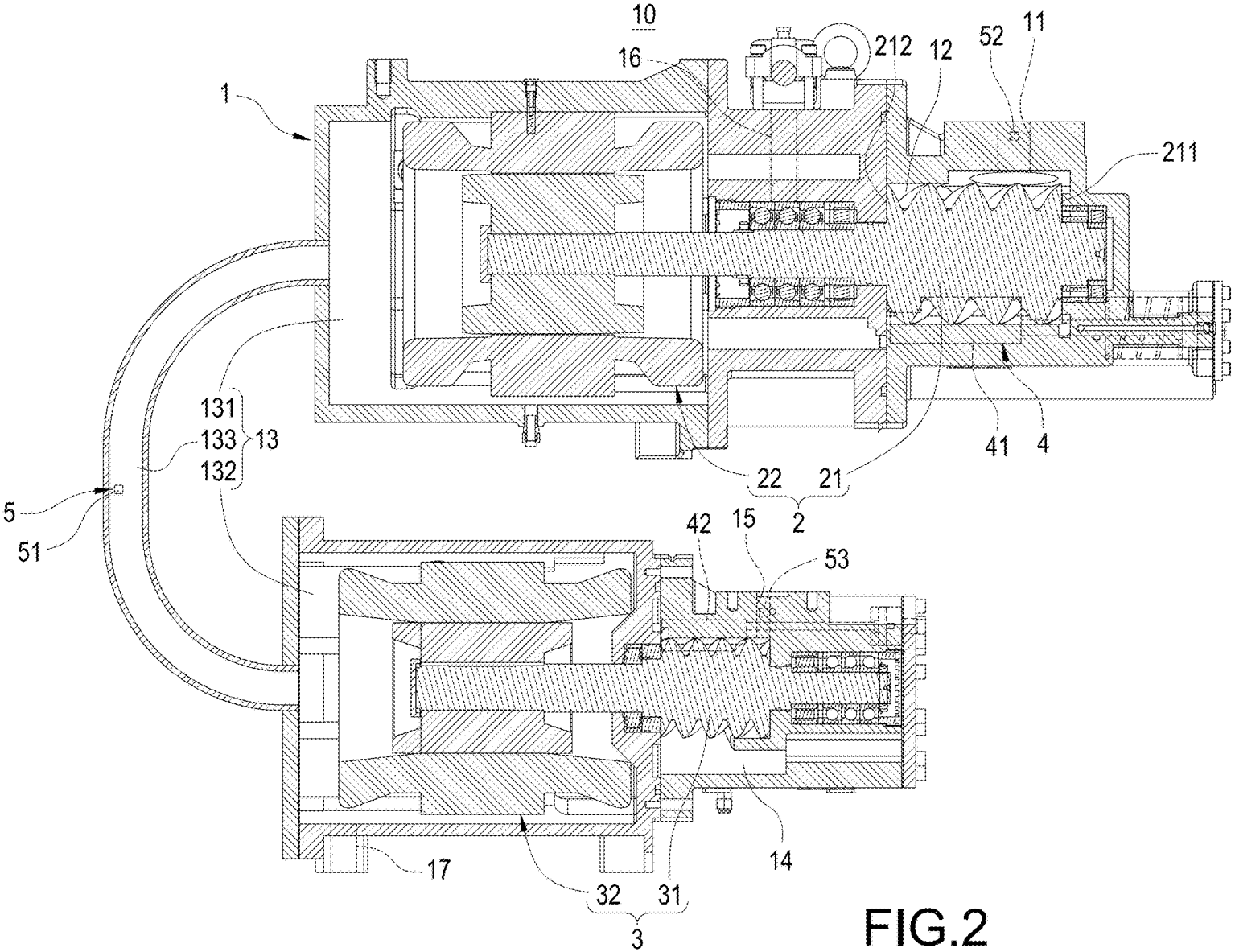
FIG. 2 is a cross sectional view showing the two-stage refrigerant compressor according the second embodiment of the present disclosure.
Figure 3:
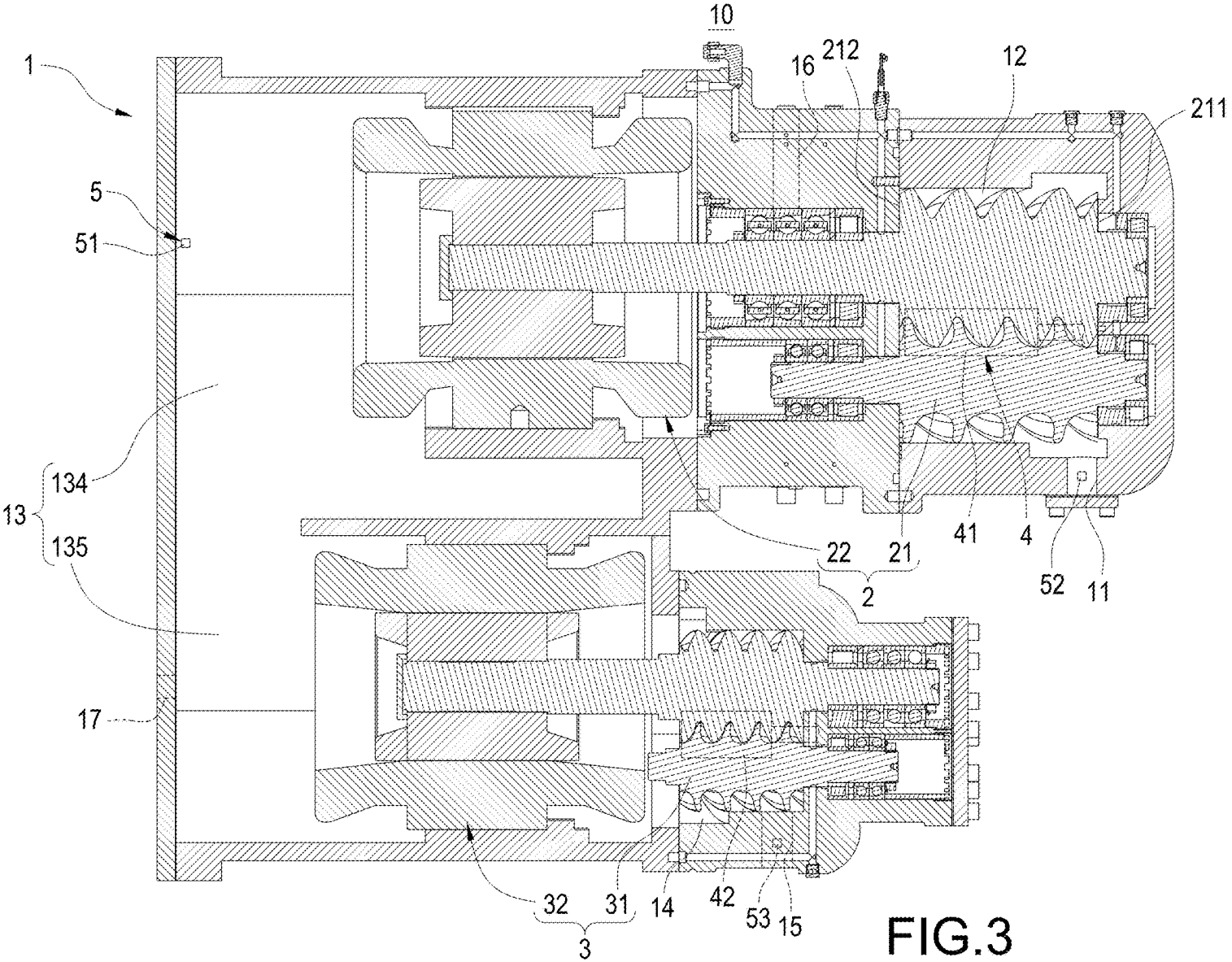
FIG. 3 is a cross sectional view showing the two-stage refrigerant compressor according the third embodiment of the present disclosure.
Figure 4:
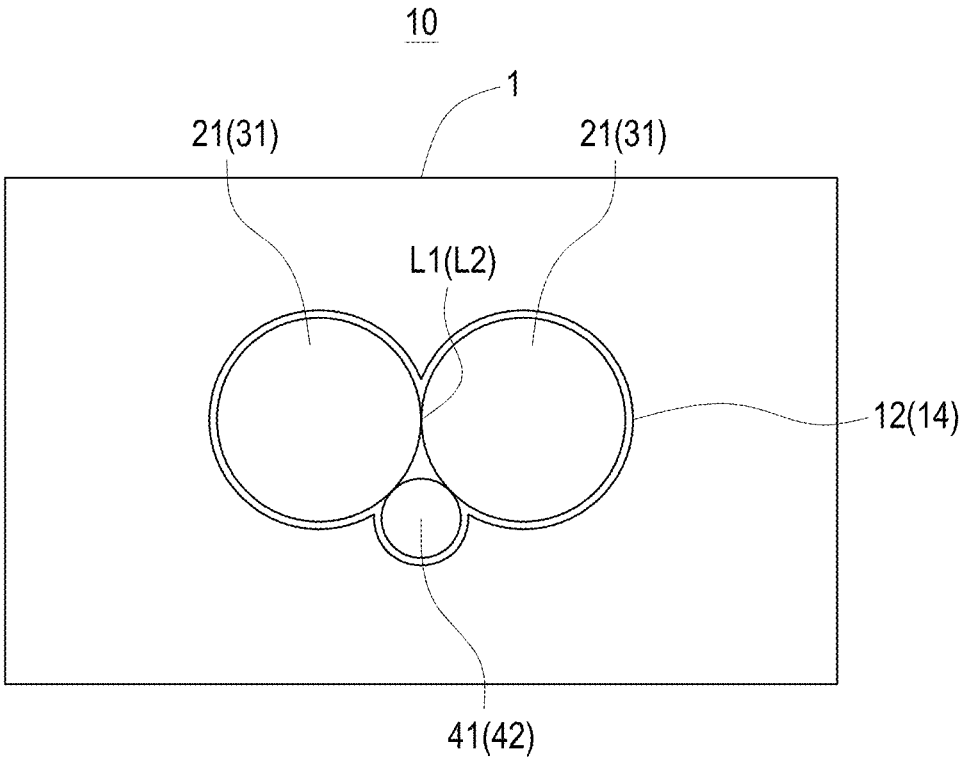
FIG. 4 is a schematic view showing a location relation of the first (the second) screw rod and the first (the second) slide valve according to the present disclosure.

As shown from FIG. 1 to FIG. 3, an inner space of the housing 1 is divided into an air suction channel 11, a first compressing room 12, an electric machine room 13, a second compressing room 14 and an air discharge channel 15 sequentially arranged and communicating with each other.

As shown from FIG. 1 to FIG. 3, the first compressor module 2 includes a pair of first screw rods 21 and a first motor 22. The pair of first screw rods 21 are disposed in the first compressing room 12 and mutually engaged. The first motor 22 is disposed in the electric machine room 13 and configured to drive one of the first screw rods 21 to rotate. A first contact line L1 is defined between a male spiral gear surface and a female spiral gear surface formed by the pair of first screw rods 21 being mutually engaged.

Two ends of the pair of the first screw rods 21 have a suction end 211 and a discharge end 212. The suction end 211 is arranged closer to the air suction channel 11 relative to the discharge end 212.

As shown from FIG. 1 to FIG. 3, the second compressor module 3 includes a pair of second screw rods 31 and a second motor 32. The pair of second screw rods 31 are disposed in the second compressing room 14 and mutually engaged. The second motor 32 is disposed in the electric machine room 13 and configured to drive one of the second screw rods 31 to rotate. A second contact line L2 is defined between a male spiral gear surface and a female spiral gear surface formed by the pair of second screw rods 31 being mutually engaged.

The first motor 22 directly drives the first screw rod 21 to rotate. The second motor 32 directly drives the second screw rod 31 to rotate, thus a rotating speed of the first screw rod 21 and a rotating speed of the second screw rod 31 may be controlled without gear set between the first compressor module 2 and the second compressor module 3.

The two-stage refrigerant compressor 10 is configured to boost a fluid (not shown in figures), for example a refrigerant and a cooling liquid, from a low pressure to a high pressure. The fluid is sucked in from the air suction channel 11 and sequentially passes the first compressing room 12, a suction end 211 of the first screw rod 21, a discharge end 212 of the first screw rod 21, the electric machine room 13, the first motor 22, the second motor 32, the second compressing room 14, the second screw rod 31 and then discharged via the air discharge channel 15. The fluid is firstly compressed by the first screw rod 21 and then compressed by the second screw rod 31 to make fluid pressures in the first compressing room 12, the electric machine room 13 and the second compressing room 14 be respectively formed in a low pressure, a middle pressure and a high pressure.

The first motor 22 and the second motor 32 of the two-stage refrigerant compressor 10 are disposed in the single electric machine room 13 as shown in FIG. 1 or FIG. 3, or the first motor 22 and the second motor 32 are separately disposed according to different designs as shown in FIG. 2, and a connection channel 133 is provided for communicating the first motor 22 and the second motor 32.

A fluid having a cooling function (for example a low-temperature refrigerant ejected by an energy saver) is filled in the electric machine room 13, and follows a working fluid (for example a refrigerant) to sequentially cool down the first motor 22 and the second motor 32, and is then discharged via the air discharge channel 15 of the second compressing room 14 to prevent a refrigerating performance of the two-stage refrigerant compressor 10 from being affected by heat generated when the first motor 22 and the second motor 32 are in an operating status.

As shown from FIG. 1 to FIG. 3, the housing 1 is disposed with a first cooling liquid ejecting port 16 disposed and communicating between the first compressing room 12 and a first electric machine room 131. The first cooling liquid (for example the low-temperature refrigerant) is filled in between the first compressing room 12 and the first electric machine room 131 via the first cooling liquid ejecting port 16 and follows the working fluid (for example the refrigerant) to cool down the first motor 22; and/or the housing 1 is disposed with a second cooling liquid ejecting port 17 communicating with a second electric machine room 132 and arranged corresponding to the second motor 32. The second cooling liquid (for example the low-temperature refrigerant) is filled in the second electric machine room 132 via the second cooling liquid ejecting port 17 and follows the working fluid (for example the refrigerant) to cool down the second motor 32. Please refer to FIG. 1 and FIG. 2, the second cooling liquid ejecting port 17 and the second electric machine room 132 communicate in a vertical manner (based on a long axial direction of the second screw rod 31 as shown in FIG. 1) and disposed at one end of the second motor 32 away from the second screw rod 31. After the second cooling liquid is discharged from the second cooling liquid ejecting port 17, the second cooling liquid flows towards the second motor 32 in a vertical direction or in an inclined direction.

In some embodiments, the second cooling liquid ejecting port 17 communicates with a second electric machine zone 135 in a horizontal (parallel) manner as shown in FIG. 3 (based on the long axial direction of the second screw rod 31 as shown in FIG. 1) and disposed at one end of the second motor 32 away from the second screw rod 31. After the second cooling liquid is discharged from the second cooling liquid ejecting port 17, the second cooling liquid flows towards the second motor 32 (or a first electric machine room 134 and the second electric machine zone 135) in a parallel manner (horizontal direction).

When being operated, an arrangement of the second cooling liquid ejecting port 17 making the second cooling liquid flow towards the second motor 32 in the vertical direction, in the inclined direction or in the horizontal direction is determined according to different construction designs. When the second electric machine room 132 (or the second electric machine zone 135) is disposed below the first electric machine room 131 (or the first electric machine zone 134), or when the first electric machine room 131 (or the first electric machine zone 134) and the second electric machine room 132 (or the second electric machine zone 135) are arranged with a left/right manner, the housing 1 is disposed with the second cooling liquid ejecting port 17 to communicate with the second electric machine room 132 (or the second electric machine zone 135), and the second cooling liquid (example a lubricating liquid or the low-temperature refrigerant) is filled in the second electric machine room 132 to make the second motor 32 cool down, and the lubricating liquid in the second electric machine room 132 (or the second electric machine zone 135) is vaporized to make the vaporized lubricating liquid and the working fluid be discharged via the air discharge channel 15, thus the lubricating liquid accumulated in the second electric machine room 132 (or the second electric machine zone 135) is reduced.

Please refer from FIG. 1 to FIG. 4, the adjustment mechanism 4 includes a first slide valve 41 and a second slide valve 42. The first slide valve 41 is moveably disposed corresponding to the first contact line L1 to control an air suction pressure, an air discharge pressure and a discharge timing of the first compressing room 12. The second slide valve 42 is moveably disposed corresponding to the second contact line L2 to control an air suction pressure, an air discharge pressure and a discharge timing of the second compressing room 14.

Please refer from FIG. 1 to FIG. 3, the pressure sensing set 5 at least includes a middle pressure sensor 51, an air suction pressure sensor 52 and an air discharge pressure sensor 53. The middle pressure sensor 51 is disposed in the electric machine room 13 to obtain a current middle pressure. The current middle pressure is an internal fluid pressure of the electric machine 13. The air suction pressure sensor 52 is disposed in the air suction channel 11 to obtain an air suction pressure. The air suction pressure is an internal fluid pressure of the air suction channel 11. The air discharge pressure sensor 53 is disposed in the air discharge channel 15 to obtain an air discharge pressure. The air discharge pressure is an internal fluid pressure of the air discharge channel 15.

Details are provided as follows. Please refer to FIG. 1 and FIG. 2, according to the first and the second embodiments of the two-stage refrigerant compressor 10 disclosed in the present disclosure, the electric machine room 13 includes the first electric machine room 131 communicating with the first compressing room 12, the second electric machine room 132 communicating with the second compressing room 14 and the connection channel 133 having two ends respectively communicating with the first electric machine room 131 and the second electric machine room 132. The first motor 22 is disposed in the first electric machine room 131. The second motor 32 is disposed in the second electric machine room 132. The middle pressure sensor 51 is disposed in one of the first electric machine room 131, the second electric machine room 132 and the connection channel 133.

Please refer to FIG. 1 to FIG. 2, which discloses the first embodiment of the two-stage refrigerant compressor 10 disclosed in the present disclosure. The fluid in the housing 1 passes through the electric machine room 13 by subsequently passing the first electric machine room 131, the connection channel 133 and the second electric machine room 132.

As shown in FIG. 1, the connection channel 133 is a vertical channel having two ends connected between a top side and a bottom side of the first electric machine room 131 and the second electric machine room 132, in other words one end of the connection channel 133 communicates with the second electric machine room 132 in the vertical direction or in an inclined direction (based on the long axial direction of the second screw rod 31 as shown in FIG. 1), after the fluid is discharged via the connection channel 133, the fluid flows towards the second motor 32 in the vertical direction. The first electric machine room 131 and the second electric machine room 132 are top/down arranged or left/right arranged, here is not intended to be limiting.

As shown in FIG. 2, the connection channel 133 is a bent tubular channel having two ends connected to one side of the first electric machine room 131 and one side of the second electric machine room 132, in other words one end of the connection channel 133 communicates with the second electric machine room 132 in the horizontal direction or in an inclined direction (based on a long axial direction of the second screw rod 31 as shown in FIG. 2), after the fluid is discharged via the connection channel 133, the fluid flows towards the second motor 32 in the inclined direction or in the horizontal direction. The first electric machine room 131 and the second electric machine room 132 are top/down arranged or left/right arranged, here is not intended to be limiting.

Moreover, the connection channel 133 is a U-shaped channel having two ends connected to one side of the first electric machine room 131 and one side of the second electric machine room 132, in other words one end of the connection channel 133 communicates with the second electric machine room 132 in the horizontal direction (based on the long axial direction of the second screw rod 31 as shown in FIG. 1 and FIG. 2), after the fluid is discharged via the connection channel 133, the fluid flows towards the second motor 32 in the horizontal direction, thus vibrations applied by the fluid to the operating second motor 32 and the second screw rod 31 are reduced.

As shown FIG. 3, which discloses the third embodiment of the two-stage refrigerant compressor 10 disclosed in the present disclosure. The electric machine room 13 is formed with the first electric machine zone 134 communicating with the first compressing room on one half 12 and formed with the second electric machine zone 135 on another half and communicating with the second compressing room 14. The first motor 22 is disposed in the first electric machine zone 134. The second motor 32 is disposed in the second electric machine zone 135. The middle pressure sensor 51 is disposed in one of the first electric machine zone 134 and the second electric machine zone 135.

As shown in FIG. 3, which discloses the third embodiment of the two-stage refrigerant compressor 10 disclosed in the present disclosure. The fluid in the housing 1 passes the electric machine room 13 by subsequently passing the first electric machine zone 134 and the second electric machine zone 135. The first electric machine zone 134 and the second electric machine zone 135 are top/down arranged or left/right arranged, here is not intended to be limiting.

The processor (not shown in figures) is connected to the first motor 22, the second motor 32, the first slide valve 41, the second slide valve 42, the middle pressure sensor 51, the air suction pressure sensor 52 and the air discharge pressure sensor 53. The processor is configured to receive the data of the middle pressure, the air suction pressure and the air discharge pressure, control the rotating speed of the first motor 22 and the second motor 32 and control the location of the first slide valve 41 and the second slide valve 42.

Details are provided as follows. The processor includes a central process unit (CPU), a micro process unit (MPU) and a digital signal processor (DSP) disposed in the housing 1, in a remote computer (not shown in figures), a server (not shown in figures), the first motor 22 or the second motor 32, and an actuator connected to the first slide valve 41 and the second slide valve 42 and configured to drive the first slide valve 41 and the second slide valve 42 to move.

Figure 5:
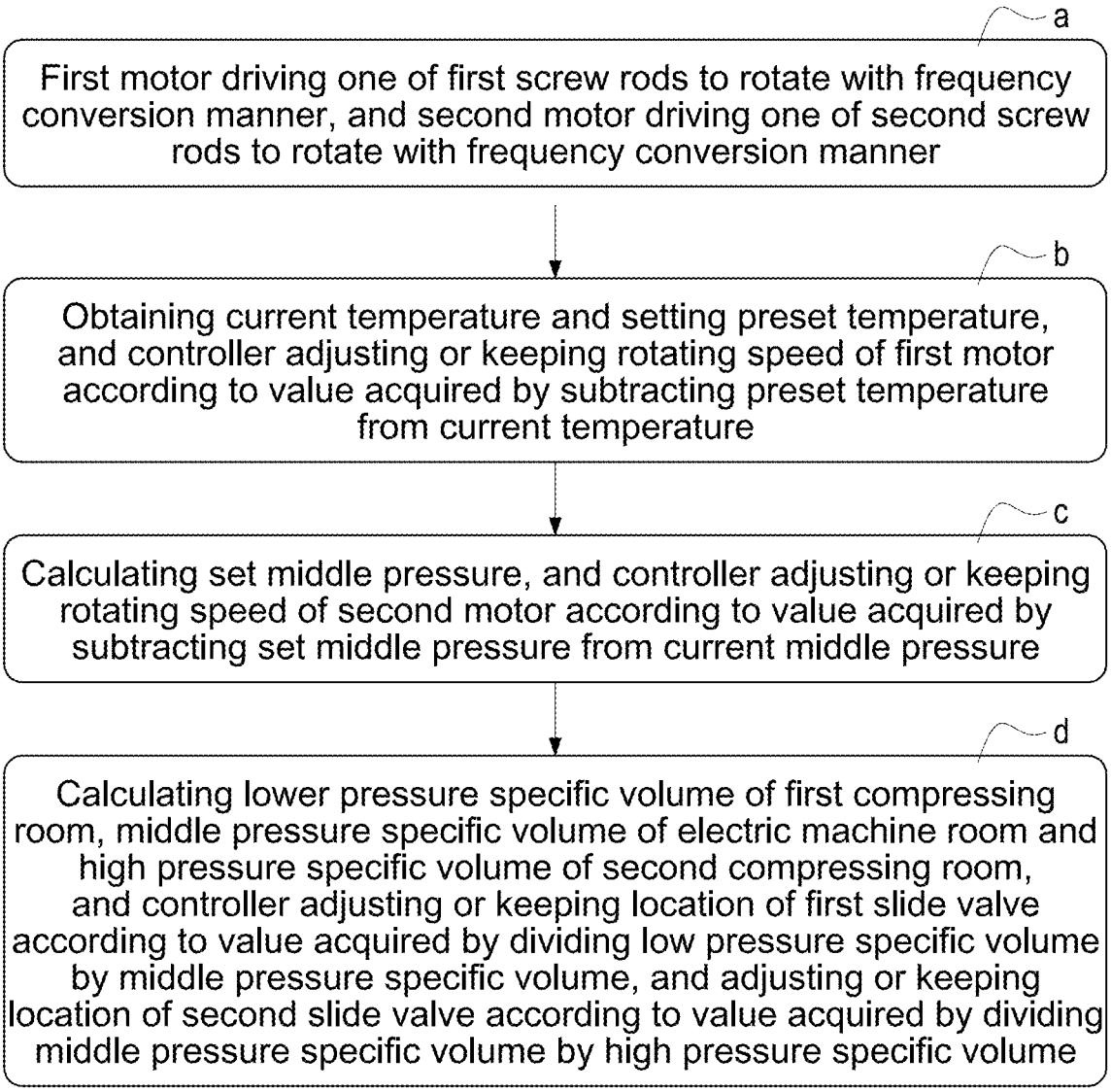
FIG. 5 is a flowchart showing the steps of the operation method of the two-stage refrigerant compressor according the first embodiment of the present disclosure.

Please refer to FIG. 5, which is a flowchart showing an operation method of the two-stage refrigerant compressor 10 according to the first embodiment of the present disclosure. Please refer to FIG. 6 and FIG. 7, which are flowcharts showing the operation method of the two-stage refrigerant compressor 10 according to the first embodiment and the second embodiment of the present disclosure.

Details are provided as follows. The operation method includes a step a) providing a foresaid two-stage refrigerant compressor 10, the first motor 22 driving the first screw rod 21 to rotate with a frequency conversion manner and the second motor 32 driving the second screw rod 31 to rotate with the frequency conversion manner, as shown in FIG. 5, FIG. 1 to FIG. 4 and FIG. 6 and FIG. 7.

A step b) obtaining a current temperature T1 and setting a preset temperature T2, and a controller adjusting or keeping the rotating speed of the first motor 22 according to a value acquired by subtracting the preset temperature T2 from the current temperature T1, as shown in FIG. 5, FIG. 1 to FIG. 4 and FIG. 6 and FIG. 7.

The current temperature T1 is a temperature of an indoor space (for example the interior of a room or a freezer) where the two-stage refrigerant compressor 10 is disposed. The preset temperature T2 is a desired temperature of the indoor space (for example the interior of the room or the freezer) set by a user.

Figure 6:
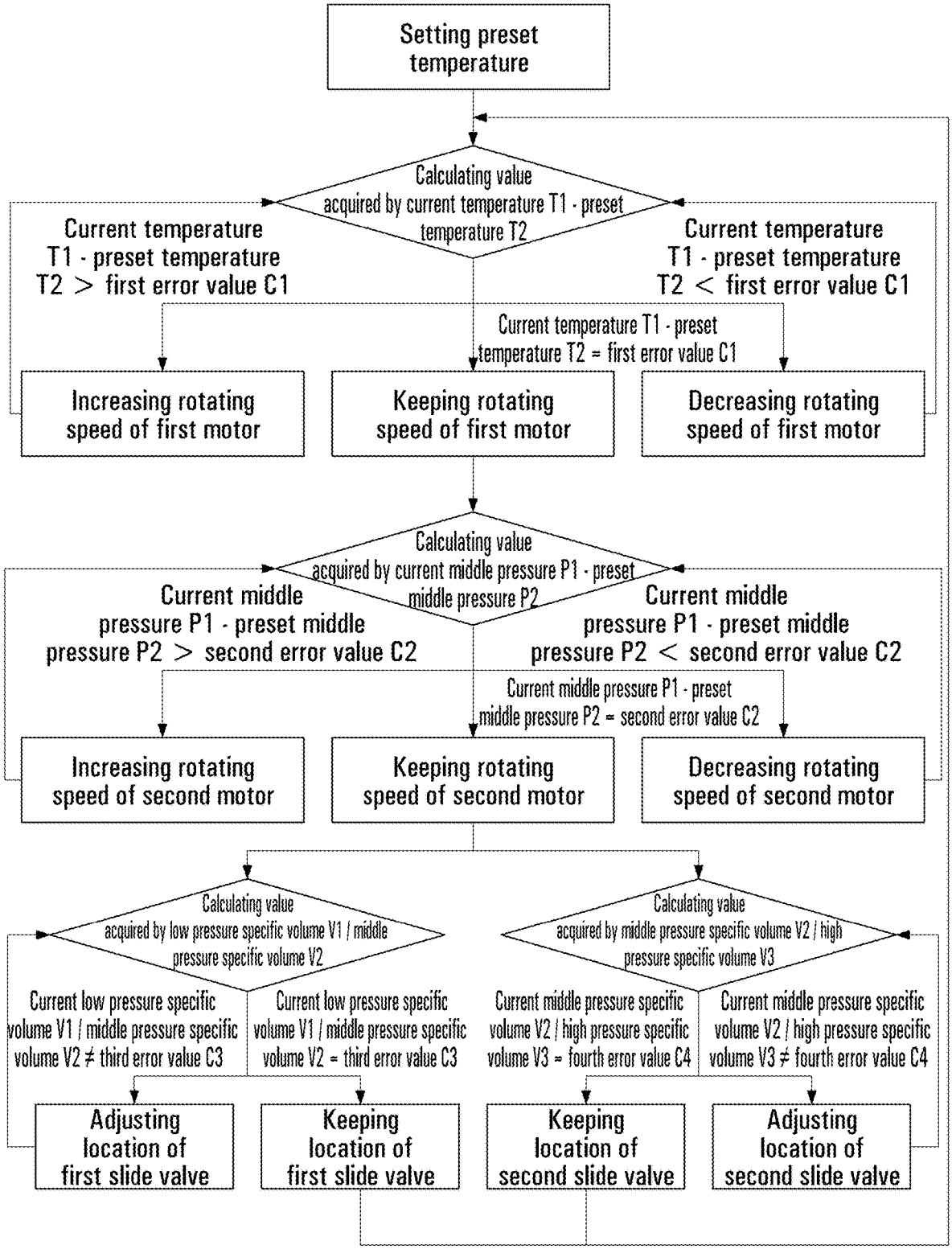
FIG. 6 is a flowchart showing the operation method of the two-stage refrigerant compressor according the first embodiment of the present disclosure.

The operation method according to the first embodiment shown in FIG. 6 is provided as follows. When the two-stage refrigerant compressor 10 is operated for refrigerating, when the value acquired by subtracting the preset temperature T2 from the current temperature T1 is to a first error value C1, the controller keeps the rotating speed of the first motor 22. When the value acquired by subtracting the preset temperature T2 from the current temperature T1 is greater than the first error value C1, the controller increases the rotating speed of the first motor 22. When the value acquired by subtracting the preset temperature T2 from the current temperature T1 is smaller than the first error value C1, the controller decreases the rotating speed of the first motor 22.

Figure 7:
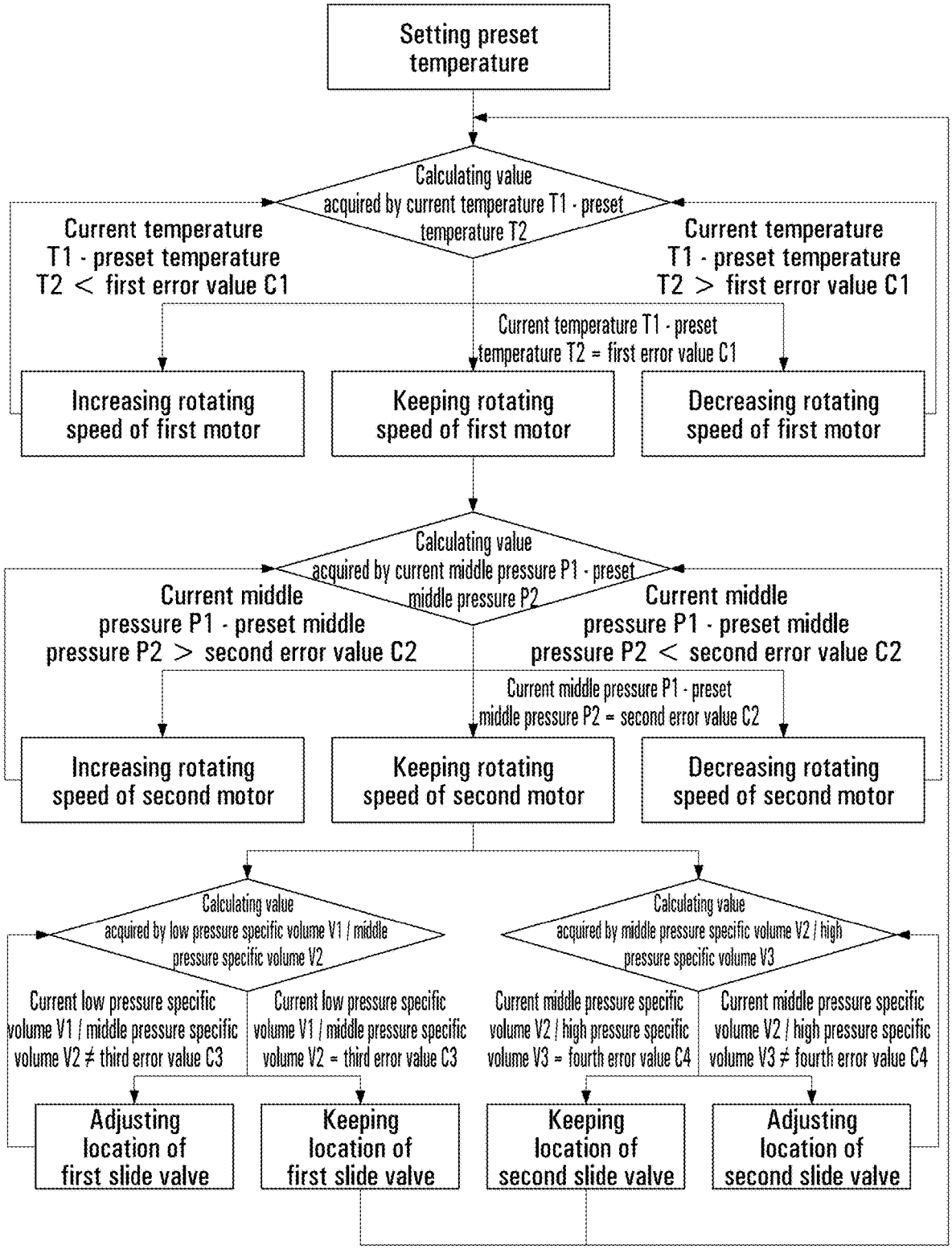
FIG. 7 is a flowchart showing the operation method of the two-stage refrigerant compressor according the second embodiment of the present disclosure.

The operation method according to the second embodiment shown in FIG. 7 is provided as follows. When the two-stage refrigerant compressor 10 is operated for heating, when the value acquired by subtracting the preset temperature T2 from the current temperature T1 is equal to a first error value C1, the controller keeps the rotating speed of the first motor 22, in other words keeping the rotating speed of the first screw rod 21. When the [valve] value acquired by subtracting the preset temperature T2 from the current temperature T1 is smaller than the first error value C1, the controller increases the rotating speed of the first motor 22, in other words increasing the rotating speed of the first screw rod 21. When the value acquired by subtracting the preset temperature T2 from the current temperature T1 is greater than the first error value C1, the controller decreases the rotating speed of the first motor 22, in other words decreasing the rotating speed of the first screw rod 21.

An example is provided as follows. When the two-stage refrigerant compressor 10 is operated for refrigerating, the current temperature T1 in the freezer is measured to be 30° C., the user sets the preset temperature T2 in the freezer to be 20° C., and the first error value C1 is +1. The rotating speed of the first screw rod 21 increases when the current temperature T1 is higher than 21° C. The rotating speed of the first screw rod 21 decreases when the current temperature is lower than 19° C. The rotating speed of the first screw rod 21 is kept when the current temperature T1 is between 21 to 19° C. On the other hand, when the two-stage refrigerant compressor 10 is operated for heating, the current temperature T1 in the room is measured to be 20° C., the user sets the preset temperature T2 in the room to be 30° C., and the first error value is +1. The rotating speed of the first screw rod 21 decreases when the current temperature T1 is higher than 31° C. The rotating speed of the first screw rod 21 increases when the current temperature T1 is lower than 29° C. The rotating speed of the first screw rod 21 is kept, when the current temperature T1 is between 31 to 29° C. A range of the first error value C1 is determined according to different operating statues.

A step c) calculating a set middle pressure P2, and the controller adjusting or keeping the rotating speed of the second motor 32 according to a value acquired by subtracting the set middle pressure P2 from a current middle pressure P1, as shown in FIG. 5, FIG. 1 to FIG. 4 and FIG. 6 and FIG. 7.

Details are provided as follows. When the value acquired by subtracting the set middle pressure P2 from the current middle pressure P1 is equal to a second error value C2, the controller keeps the rotating speed of the second motor 32, in other words keeping the rotating speed of the second screw rod 31. When the value acquired by subtracting the set middle pressure P2 from the current middle pressure P1 is greater than the second error value C2, the controller increases the rotating speed of the second motor 32, in other words increasing the rotating speed of the second screw rod 31. When the value acquired by subtracting the set middle pressure P2 from the current middle pressure P1 is smaller than the second error value C2, the controller decreases the rotating speed of the second motor 32, in other words decreasing the rotating speed of the second screw rod 31.

The set middle pressure P2 is calculated by a formula:

$$P2 = k1 + k2 \times Psuc + k3 \times Pdis + k4 \times \sqrt{Psuc \times Pdis} + k5 \times \frac{Pdis}{Psuc},$$

wherein P2 is the set middle pressure, Psuc is an air suction pressure, Pdis is the air discharge pressure, k1 is a first experience coefficient, k2 is a second experience coefficient, k3 is a third experience coefficient, k4 is a fourth experience coefficient, and k5 is a fifth experience coefficient. The experience coefficients are calculated by being measured or simulated.

In some embodiments, a reference middle pressure, a reference air suction pressure, a reference air discharge pressure are acquired by being firstly measured in a laboratory or a production line and then inputted into a coefficient calculation unit. The coefficient calculation unit is a calculation unit to make the reference middle pressure, the reference air suction pressure and the reference air discharge pressure be imputed and calculate to output the first experience coefficient, the second experience coefficient, the third experience coefficient, the fourth experience coefficient and the fifth experience coefficient.

The measuring field is not limited to the laboratory or the production line, the measuring field may be an on-line system. When an actual fluid machinery is operated, the fluid machinery measures the reference middle pressure, the reference air suction pressure and the reference air discharge pressure and inputs into the coefficient calculation unit to calculate and output the first experience coefficient, the second experience coefficient, the third experience coefficient, the fourth experience coefficient and the fifth experience coefficient.

The reference middle pressure, the reference air suction pressure and the reference air discharge pressure are not limited by being acquired with a measuring manner. The measurement process may be a simulated result which utilizes a computer aided engineering (CAE) software to simulate an operating status of the fluid machinery to acquire the simulated reference middle pressure, the reference air suction pressure, and the reference air discharge pressure and input into the coefficient calculation unit, thus the first experience coefficient, the second experience coefficient, the third experience coefficient, the fourth experience coefficient and the fifth experience coefficient are calculated and outputted.

An example is provided as follows. The measured current middle pressure P1 minus the set middle pressure P2 of the aforesaid calculation formula, for example the set middle pressure is 8 kg/cm$^2$G, the second error value C2 is ±0.2. When the measured current middle pressure is greater than 8.2 g/cm$^2$G, the rotating speed of the second screw rod 31 increases. When the measured current middle pressure P1 is smaller than 7.8 kg/cm$^2$G, the rotating speed of the second screw rod 31 decreases. When the measured current middle pressure P1 is between 8.2~7.8 kg/cm$^2$G, the rotating speed of the second screw rod 31 is kept. A range of the second error value C2 is determined according to different operating statues.

A step d) calculating a lower pressure specific volume V1 of the first compressing room 12, a middle pressure specific volume V2 of the electric machine room 13 and a high pressure specific volume V3 of the second compressing room 14, and the controller adjusting or keeping the location of the first slide valve 41 according to a value acquired by dividing the low pressure specific volume V1 by the middle pressure specific volume V2, and adjusting or keeping the location of the second slide valve 42 according to a value acquired by dividing the middle pressure specific volume V2 by the high pressure specific volume V3, as shown in FIG. 5, FIG. 1 to FIG. 4 and FIG. 6 and FIG. 7.

The specific volume V is calculated by the pressure, the temperature and the curve fitting of a compressor. The low pressure specific volume V1 is calculated by the pressure and the temperature of the first compressing room 12. The middle pressure specific volume V2 is calculated by the pressure and the temperature of the electric machine room 13. The high pressure specific volume V3 is calculated by the pressure and the temperature of the second compressing room 14. An optimal location of the slide valve is calculated by a relation of a volume ratio of the compressor selected with respect to the type of refrigerant and the location of the slide valve.

Details are provided as follows. When the value acquired by dividing the low pressure specific volume V1 by the middle pressure specific volume V2 is equal to a third error value C3, the controller keeps the location of the first slide valve 41. When the value acquired by dividing the low pressure specific volume V1 by the middle pressure specific volume V2 is greater than or smaller than the third error value C3, the controller adjusts the location of the first slide valve 41 according to the optimal location of the slide valve calculated by a relation of a volume ratio of the compressor selected with respect to the type of coolant and the location of the slide valve. When the value acquired by dividing the middle pressure specific volume V2 by the high pressure specific volume V3 is equal to a fourth error value C4, the controller keeps the location of the second slide valve 42. When the value acquired by dividing the middle pressure specific volume V2 by the high pressure specific volume V3 is greater than or smaller than the fourth error value C4, the controller adjusts the location of the second slide valve 42 according to the optimal location of the slide valve calculated by a relation of a volume ratio of the compressor selected with respect to the type of coolant and the location of the slide valve.

An example is provided as follows. The third error value C3 is set to be 3. When the currently calculated value acquired by dividing the low pressure specific volume V1 by the middle pressure specific volume V2 is equal to 3 (equal to the third error value C3), the controller keeps the location of the first slide valve 41. When the value acquired by dividing the low pressure specific volume V1 by the middle pressure specific volume V2 is equal to 5 (greater than the third error value C3), the controller controls the first slide valve 41 to move towards the suction end 211 of the first screw rod 21 to reduce the value of the low pressure specific volume V1. When the value acquired by dividing the low pressure specific volume V1 by the middle pressure specific volume V2 is equal to 1.5 (smaller than the third error value C3), the controller controls the first slide valve 41 to move towards the discharge end 212 of the first screw rod 21 (moving away from the suction end 211 of the first screw rod 21) to increase the value of the low pressure specific volume V1.

Another example is provided as follows. The fourth error value C4 is set to be 3. When the currently calculated value acquired by dividing the middle pressure specific volume V2 by the high pressure specific volume V3 is equal to 3 (equal to the fourth error value C4), the controller keeps the location of the second slide valve 42. When the value acquired by dividing the middle pressure specific volume V2 by the high pressure specific volume V3 is equal to 5 (greater than the fourth error value C4), the controller controls the second slide valve 42 to move away from the air discharge channel 15 (moving towards the second electric machine room 132) to reduce the value of the middle pressure specific volume V2. When the value acquired by dividing the middle pressure specific volume V2 by the high pressure specific volume V3 is equal to 1.5 (smaller than the fourth error value C4), the controller controls the second slide valve 42 to move towards the air discharge channel 15 to increase the value of the middle pressure specific volume V2.

Figure 8:
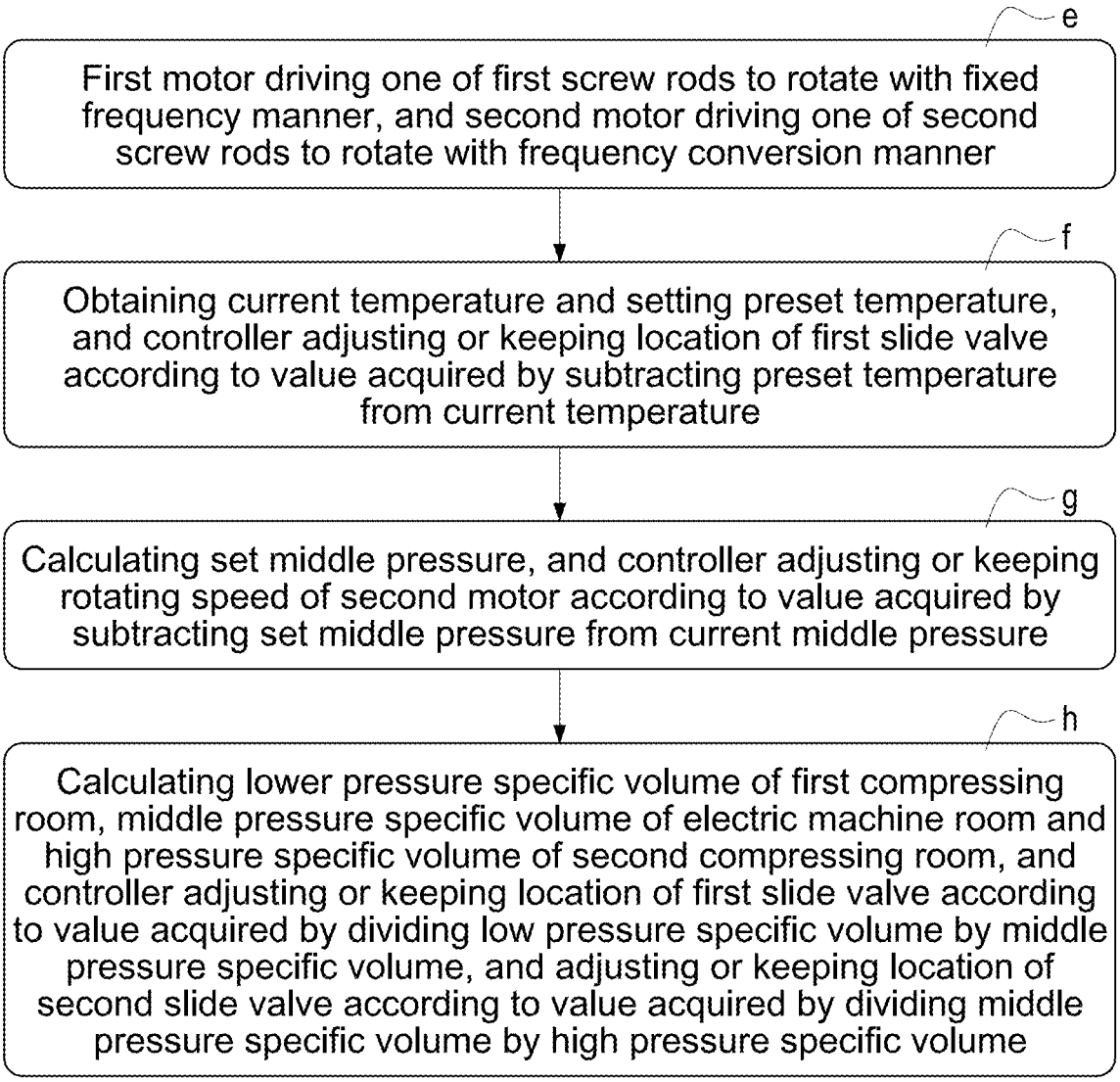
FIG. 8 is a flowchart showing the steps of the operation method of the two-stage refrigerant compressor according the second embodiment of the present disclosure.

Please refer to FIG. 8, which is a flowchart showing an operation method of the two-stage refrigerant compressor 10 according to the second embodiment of the present disclosure. Please refer to FIG. 9 and FIG. 10, which are flowcharts showing an operation method of the two-stage refrigerant compressor 10 according to the third embodiment and the fourth embodiment of the present disclosure.

Details are provided as follows. The operation method includes a step e) providing the foresaid two-stage refrigerant compressor 10, the first motor 22 driving the first screw rod 21 to rotate with a fixed frequency manner and the second motor 32 driving the second screw rod 31 to rotate with the frequency conversion manner, as shown in FIG. 8, FIG. 1 to FIG. 4 and FIG. 9 and FIG. 10.

A step f) obtaining a current temperature T1 and setting a preset temperature T2, and a controller adjusting or keeping a location of the first slide valve 41 according to a value acquired by subtracting the preset temperature T2 from the current temperature T1, as shown in FIG. 8, FIG. 1 to FIG. 4 and FIG. 9 and FIG. 10.

The current temperature T1 is a temperature of an indoor space (for example the interior of a room or a freezer) where the two-stage refrigerant compressor 10 is disposed. The preset temperature T2 is a desired temperature of the indoor space (for example the interior of the room or the freezer) set by a user.

Figure 9:
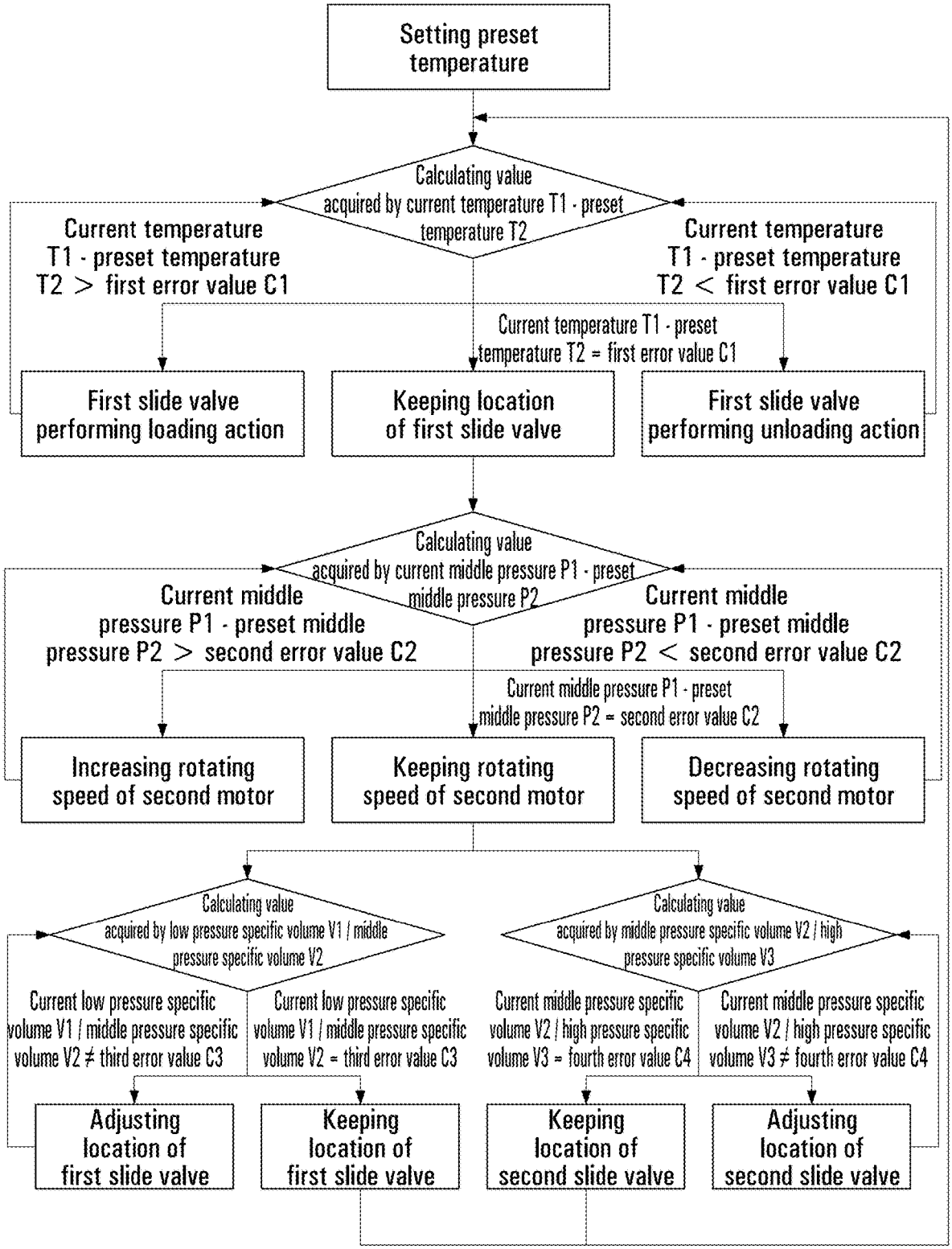
FIG. 9 is a flowchart showing the operation method of the two-stage refrigerant compressor according the third embodiment of the present disclosure.

The operation method according to the third embodiment shown in FIG. 9 is provided as follows. When the two-stage refrigerant compressor 10 is operated for refrigerating, when the value acquired by subtracting the preset temperature T2 from the current temperature T1 is equal to the first error value C1, the controller keeps the location of the first slide valve 41. When the [valve] value acquired by subtracting the preset temperature T2 from the current temperature T1 is greater than the first error value C1, the controller controls the first slide valve 41 to perform a loading action. The loading action makes the first slide valve 41 move towards the suction end 211 of the first screw rod 21. When the value acquired by subtracting the preset temperature T2 from the current temperature T1 is smaller than the first error value C1, the controller controls the first slide valve 41 to perform an unloading action. The unloading action makes the first slide valve 41 move towards the discharge end 212 of the first screw rod 21.

Figure 10:
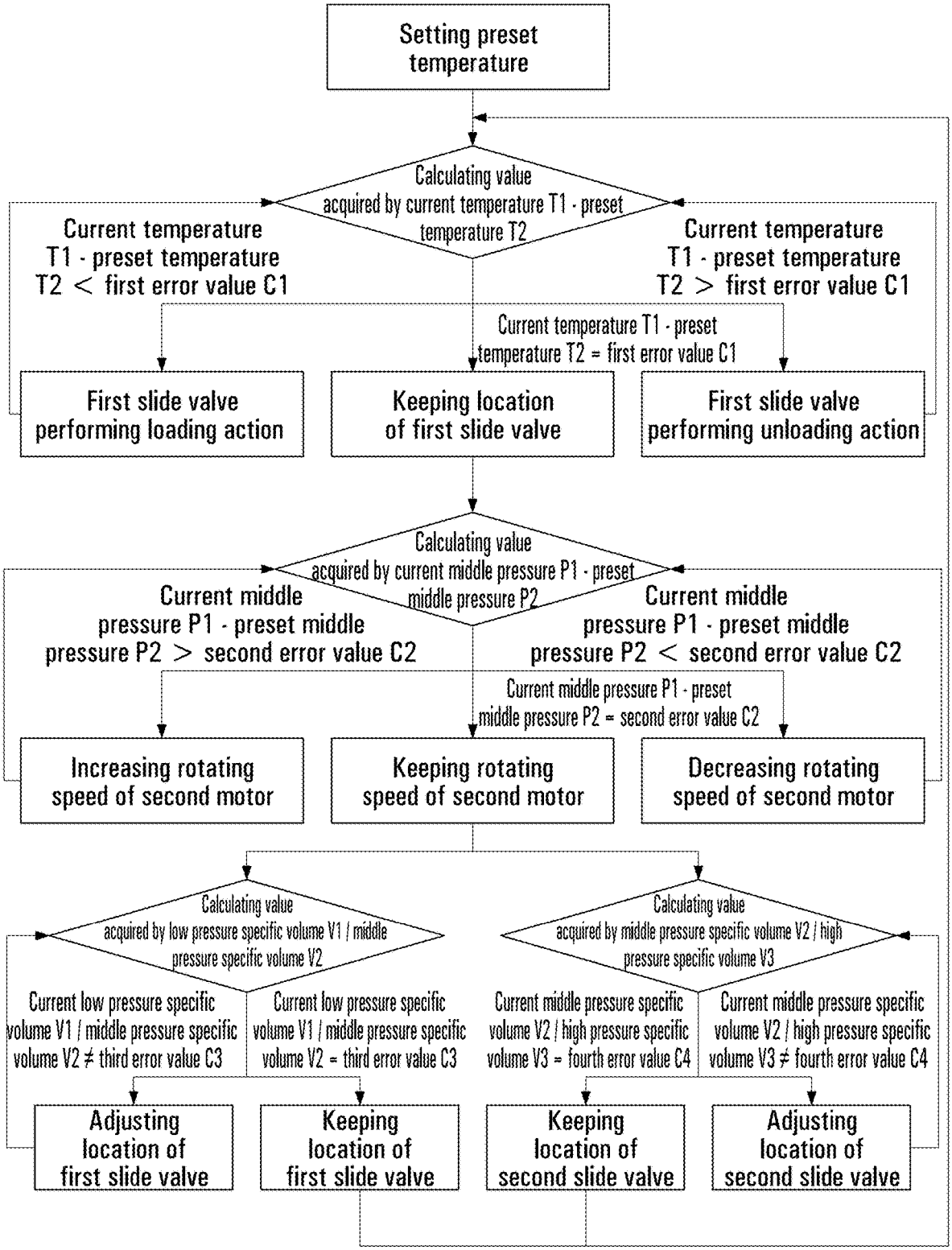
FIG. 10 is a flowchart showing the operation method of the two-stage refrigerant compressor according the fourth embodiment of the present disclosure.

The operation method according to the fourth embodiment shown in FIG. 10 is provided as follows. When the two-stage refrigerant compressor 10 is operated for heating, when the value acquired by subtracting the preset temperature T2 from the current temperature T1 is equal to the first error value C1, the controller keeps the location of the first slide valve 41. When the value acquired by subtracting the preset temperature T2 from the current temperature T1 is smaller than the first error value C1, the controller controls the first slide valve 41 to perform the loading action. The loading action makes the first slide valve 41 move towards the suction end 211 of the first screw rod 21. When the value acquired by subtracting the preset temperature T2 from the current temperature T1 is greater than the first error value C1, the controller controls the first slide valve 41 to perform the unloading action. The unloading action makes the first slide valve 41 move towards the discharge end 212 of the first screw rod 21.

An example is provided as follows. When the two-stage refrigerant compressor 10 is operated for refrigerating, the current temperature T1 in the freezer is measured to be 30° C., the user sets the preset temperature T2 in the freezer to be 20° C., and the first error value C1 is ±1. The controller controls the first slide valve 41 to perform the loading action when the current temperature T1 is higher than 21° C. The loading action makes the first slide valve 41 move towards the suction end 211 of the first screw rod 21. The controller controls the first slide valve 41 to perform the unloading action when the current temperature is lower than 19° C. The unloading action makes the first slide valve 41 move towards the discharge end 212 of the first screw rod 21. The controller keeps the location of the first slide valve 41 when the current temperature T1 is between 21 to 19° C. A range of the first error value C1 is determined according to different operating statues.

When the two-stage refrigerant compressor 10 is operated for heating, the current temperature T1 in the room is measured to be 20° C., the user sets the preset temperature T2 in the room to be 30° C., and the first error value is ±1. The controller controls the first slide valve 41 to perform the unloading action when the current temperature T1 is higher than 31° C. The unloading action makes the first slide valve 41 move towards the discharge end 212 of the first screw rod 21. The controller controls the first slide valve 41 to perform the loading action when the current temperature is lower than 29° C. The loading action makes the first slide valve 41 move towards the suction end 211 of the first screw rod 21. The controller keeps the location of the first slide valve 41 when the current temperature T1 is between 31 to 29° C. A range of the first error value C1 is determined according to different operating statues.

A step g) calculating a set middle pressure P2, and the controller adjusting or keeping the rotating speed of the second motor 32 according to a value acquired by subtracting the set middle pressure P2 from the current middle pressure P1, as shown in FIG. 8, FIG. 1 to FIG. 4 and FIG. 9 and FIG. 10.

Details are provided as follows. When the value acquired by subtracting the set middle pressure P2 from the current middle pressure P1 is equal to the second error value C2, the controller keeps the rotating speed of the second motor 32, in other words keeping the rotating speed of the second screw rod 31. When the value acquired by subtracting the set middle pressure P2 from the current middle pressure P1 is greater than the second error value C2, the controller increases the rotating speed of the second motor 32, in other words increasing the rotating speed of the second screw rod 31. When the value acquired by subtracting the set middle pressure P2 from the current middle pressure P1 is smaller than the second error value C2, the controller decreases the rotating speed of the second motor 32, in other words decreasing the rotating speed of the second screw rod 31. Examples haves been provided in the step c) disclosed in the first and the second embodiments, therefore no further illustration is provided.

The set middle pressure P2 is calculated by a formula:

$$P2 = k1 + k2 \times Psuc + k3 \times Pdis + k4 \times \sqrt{Psuc \times Pdis} + k5 \times \frac{Pdis}{Psuc},$$

wherein P2 is the set middle pressure, Psuc is an air suction pressure, Pdis is the air discharge pressure, k1 is a first experience coefficient, k2 is a second experience coefficient, k3 is a third experience coefficient, k4 is a fourth experience coefficient, and k5 is a fifth experience coefficient, as what has been disclosed above.

A step h) calculating the lower pressure specific volume V1 of the first compressing room 12, the middle pressure specific volume V2 of the electric machine room 13 and the high pressure specific volume V3 of the second compressing room 14, and the controller adjusting or keeping the location of the first slide valve 41 according to the value acquired by dividing the low pressure specific volume V1 by the middle pressure specific volume V2, and adjusting or keeping a location of the second slide valve 42 according to the value acquired by dividing the middle pressure specific volume V2 by the high pressure specific volume V3, as shown in FIG. 8, FIG. 1 to FIG. 4 and FIG. 9 and FIG. 10.

The specific volume V is calculated by the pressure, the temperature and the curve fitting of the compressor. The low pressure specific volume V1 is calculated by the pressure and the temperature of the first compressing room 12. The middle pressure specific volume V2 is calculated by the pressure and the temperature of the electric machine room 13. The high pressure specific volume V3 is calculated by the pressure and the temperature of the second compressing room 14. The optimal location of the slide valve is calculated by a relation of a volume ratio of the compressor selected with respect to the type of refrigerant and the location of the slide valve.

Details are provided as follows. When the value acquired by dividing the low pressure specific volume V1 by the middle pressure specific volume V2 is equal to the third error value C3, the controller keeps the location of the first slide valve 41. When the value acquired by dividing the low pressure specific volume V1 by the middle pressure specific volume V2 is greater than or smaller than the third error value C3, the controller adjusts the location of the first valve 41 according to the optimal location of the slide valve calculated by a relation of a volume ratio of the compressor selected with respect to the type of coolant and the location of the slide valve. When the value acquired by dividing the middle pressure specific volume V2 by the high pressure specific volume V3 is equal to a fourth error value C4, the controller keeps the location of the second slide valve 42. When the value acquired by dividing the middle pressure specific volume V2 by the high pressure specific volume V3 is greater than or smaller than the fourth error value C4, the controller adjusts the location of the second slide valve 42 according to the optimal location of the slide valve calculated by a relation of a volume ratio of the compressor selected with respect to the type of coolant and the location of the slide valve. Examples haves been provided in the step d) disclosed in the first and the second embodiments, therefore no further illustration is provided.

Accordingly, an adjustable compression ratio is achieved by the rotating speed of the first screw rod 21 and the rotating speed of the second screw rod 31, an adjustable volume ratio is achieved by controlling the location of the first slide valve 41 and the location of the second slide valve 42, thus all possible factors affecting the performance of the two-stage refrigerant compressor 10 are all within a controllable range, and the two-stage refrigerant compressor 10 is provided with an advantages of being in an operation mode with a best efficiency under variable operating conditions.

While this disclosure has been described by means of specific embodiments, numerous modifications and variations could be made thereto by those skilled in the art without departing from the scope and spirit of this disclosure set forth in the claims.

What is claimed is:

1. A two-stage refrigerant compressor, comprising:

a housing (1), comprising an inner space divided into an air suction channel (11), a first compressing room (12), an electric machine room (13), a second compressing room (14) and an air discharge channel (15) sequentially defined and communicating with each other;

a first compressor module (2), comprising a pair of first screw rods (21) disposed in the first compressing room (12) and mutually engaged, and a first motor (22) disposed in the electric machine room (13) and configured to drive one of the first screw rods (21) to rotate, wherein a first contact line (L1) is defined by the pair of first screw rods (21);

a second compressor module (3), comprising a pair of second screw rods (31) disposed in the second compressing room (14) and mutually engaged, and a second motor (32) disposed in the electric machine room (13) and configured to drive one of the second screw rods (31) to rotate, wherein a second contact line (L2) is defined by the pair of second screw rods (31);

an adjustment mechanism (4), comprising a first slide valve (41) moveably disposed corresponding to the first contact line (L1) and a second slide valve (42) moveably disposed corresponding to the second contact line (L2);

a pressure sensing set (5), comprising at least one middle pressure sensor (51) disposed in the electric machine room (13) to acquire a current middle pressure; and a processor, connected to the first motor (22), the second motor (32), the first slide valve (41), the second slide valve (42) and the at least one middle pressure sensor (51), and configured to receive data of the current middle pressure, control a rotating speed of the first motor (22) and a rotating speed of the second motor (32), and control a location of the first slide valve (41) and a location of second slide valve (42);

wherein, the pressure sensing set (5) further comprises an air suction pressure sensor (52) and an air discharge pressure sensor (53), the air suction pressure sensor (52) is disposed in the air suction channel (11) to acquire an air suction pressure, the air discharge pressure sensor (53) is disposed in the air discharge channel (15) to acquire an air discharge pressure, the processor is connected to the air suction pressure sensor (52) and the air discharge pressure sensor (53), and the processor is configured to receive data of the air suction pressure and the air discharge pressure.

2. The two-stage refrigerant compressor according to claim 1, wherein the electric machine room (13) comprises a first electric machine room (131) communicating with the first compressing room (12), a second electric machine room (132) communicating with the second compressing room (14) and a connection channel (133) with two ends communicating with the first electric machine room (131) and the second electric machine room (132), the first motor (22) is disposed in the first electric machine room (131), the second motor (32) is disposed in the second electric machine room (132), the at least one middle pressure sensor (51) is disposed in one of the first electric machine room (131), the second electric machine room (132) and the connection channel (133), and the first electric machine room (131) and the second electric machine room (132) are top/down or left/right arranged.

3. The two-stage refrigerant compressor according to claim 2, wherein the housing (1) comprises a first cooling liquid ejecting port (16) and/or a second cooling liquid ejecting port (17), the first cooling liquid ejecting port (16) is disposed and communicates between the first compressing room (12) and the first electric machine room (131), and the second cooling liquid ejecting port (17) communicates with the second electric machine room (132) and disposed corresponding to the second motor (32).

4. The two-stage refrigerant compressor according to claim 1, wherein the electric machine room (13) is defined to be a first electric machine zone (134) communicating with the first compressing room (12) on one half and a second electric machine zone (135) communicating with the second compressing room (14) on another half, the first motor (22) is disposed in the first electric machine zone (134), the second motor (32) is disposed in the second electric machine zone (135), the at least one middle pressure sensor (51) is disposed in one of the first electric machine zone (134) and the second electric machine zone (135), and the first electric machine zone (134) and the second electric machine zone (135) are top/down or left/right arranged.

5. The two-stage refrigerant compressor according to claim 4, wherein the housing (1) comprises a first cooling liquid ejecting port (16) and/or a second cooling liquid ejecting port (17), the first cooling liquid ejecting port (16) is disposed and communicates between the first compressing room (12) and the first electric machine zone (134), and the second cooling liquid ejecting port (17) communicates with the second electric machine zone (135) and disposed corresponding to the second motor (32).

6. An operation method of a two-stage refrigerant compressor, the operation method comprising:

a) providing the two-stage refrigerant compressor (10) as claimed in claim 1, the first motor (22) driving one of the first screw rods (21) to rotate with a frequency conversion manner, and the second motor (32) driving one of the second screw rods (31) to rotate with the frequency conversion manner;

b) obtaining a current temperature (T1) and setting a preset temperature (T2), and a controller adjusting or keeping a rotating speed of the first motor (22) according to a value acquired by subtracting the preset temperature (T2) from the current temperature (T1);

c) calculating a set middle pressure (P2), and the controller adjusting or keeping a rotating speed of the second motor (32) according to a value acquired by subtracting the set middle pressure (P2) from a current middle pressure (P1); and d) calculating a lower pressure specific volume (V1) of the first compressing room (12), a middle pressure specific volume (V2) of the electric machine room (13) and a high pressure specific volume (V3) of the second compressing room (14), and the controller adjusting or keeping a location of the first slide valve (41) according to a value acquired by dividing the low pressure specific volume (V1) by the middle pressure specific volume (V2), and adjusting or keeping a location of the second slide valve (42) according to a value acquired by dividing the middle pressure specific volume (V2) by the high pressure specific volume (V3).

7. The operation method according to claim 6, wherein the current temperature (T1) is an indoor temperature of a space where the two-stage refrigerant compressor is disposed, the preset temperature (T2) is set by a user, the set middle pressure (P2) is calculated by a formula:

$$P2 = k1 + k2 \times Psuc + k3 \times Pdis + k4 \times \sqrt{Psuc \times Pdis} + k5 \times \frac{Pdis}{Psuc},$$

wherein P2 is the set middle pressure, Psuc is an air suction pressure, Pdis is an air discharge pressure, k1 is a first experience coefficient, k2 is a second experience coefficient, k3 is a third experience coefficient, k4 is a fourth experience coefficient, and k5 is a fifth experience coefficient.

8. The operation method according to claim 6, wherein in the b), when the two-stage refrigerant compressor is operated for refrigerating and the value acquired by subtracting the preset temperature (T2) from the current temperature (T1) is equal to a first error value (C1), the controller keeps the rotating speed of the first motor (22), when the value acquired by subtracting the preset temperature (T2) from the current temperature (T1) is greater than the first error value (C1), the controller increases the rotating speed of the first motor (22), when the value acquired by subtracting the preset temperature (T2) from the current temperature (T1) is smaller than the first error value (C1), the controller decreases the rotating speed of the first motor (22).

9. The operation method according to claim 6, wherein in the b), when the two-stage refrigerant compressor is operated for heating and the value acquired by subtracting the preset temperature (T2) from the current temperature (T1) is equal to a first error value (C1), the controller keeps the rotating speed of the first motor (22), when the value acquired by subtracting the preset temperature (T2) from the current temperature (T1) is smaller than the first error value (C1), the controller increases the rotating speed of the first motor (22), when the value acquired by subtracting the preset temperature (T2) from the current temperature (T1) is greater than the first error value (C1), the controller decreases the rotating speed of the first motor (22).

10. The operation method according to claim 6, wherein in step c), when the value acquired by subtracting the set middle pressure (P2) from the current middle pressure (P1) is equal to a second error value (C2), the controller keeps the rotating speed of the second motor (32), when the value acquired by subtracting the set middle pressure (P2) from the current middle pressure (P1) is greater than the second error value (C2), the controller increases the rotating speed of the second motor (32), when the value acquired by subtracting the set middle pressure (P2) from the current middle pressure (P1) is smaller than the second error value (C2), the controller decreases the rotating speed of the second motor (32).

11. The operation method according to claim 6, wherein in the d), when the value acquired by dividing the low pressure specific volume (V1) by the middle pressure specific volume (V2) is equal to a third error value (C3), the controller keeps the location of the first slide valve (41), when the value acquired by dividing the low pressure specific volume (V1) by the middle pressure specific volume (V2) is greater than or smaller than the third error value (C3), the controller adjusts the location of the first slide valve (41), when the value acquired by dividing the middle pressure specific volume (V2) by the high pressure specific volume (V3) is equal to a fourth error value (C4), the controller keeps the location of the second slide valve (42), when the value acquired by dividing the middle pressure specific volume (V2) by the high pressure specific volume (V3) is greater than or smaller than the fourth error value (C4), the controller adjusts the location of the second slide valve (42).

12. An operation method of a two-stage refrigerant compressor, the operation method comprising:

e) providing the two-stage refrigerant compressor (10) as claimed in claim 1, the first motor (22) driving one of the first screw rods (21) to rotate with a fixed frequency manner, and the second motor (32) driving one of the second screw rods (31) to rotate with the frequency conversion manner;

f) obtaining a current temperature (T1) and setting a preset temperature (T2), and a controller adjusting or keeping a location of the first slide valve (41) according to a value acquired by subtracting the preset temperature (T2) from the current temperature (T1);

g) calculating a set middle pressure (P2), and the controller adjusting or keeping a rotating speed of the second motor (32) according to a value acquired by subtracting the set middle pressure (P2) from a current middle pressure (P1); and h) calculating a lower pressure specific volume (V1) of the first compressing room (12), a middle pressure specific volume (V2) of the electric machine room (13) and a high pressure specific volume (V3) of the second compressing room (14), and the controller adjusting or keeping the location of the first slide valve (41) according to a value acquired by dividing the low pressure specific volume (V1) by the middle pressure specific volume (V2), and adjusting or keeping a location of the second slide valve (42) according to a value acquired by dividing the middle pressure specific volume (V2) by the high pressure specific volume (V3).

13. The operation method according to claim 12, wherein the current temperature (T1) is an indoor temperature of a space where the two-stage refrigerant compressor is disposed, the preset temperature (T2) is set by a user, the set middle pressure (P2) is calculated by a formula:

$$P2 = k1 + k2 \times Psuc + k3 \times Pdis + k4 \times \sqrt{Psuc \times Pdis} + k5 \times \frac{Pdis}{Psuc},$$

wherein P2 is the set middle pressure, Psuc is an air suction pressure, Pdis is an air discharge pressure, k1 is a first experience coefficient, k2 is a second experience coefficient, k3 is a third experience coefficient, k4 is a fourth experience coefficient, and k5 is a fifth experience coefficient.

14. The operation method according to claim 12, wherein in the f), the pair of the first screw rods (21) comprise a suction end (211) and a discharge end (212), when the two-stage refrigerant compressor is operated for refrigerating and the value acquired by subtracting the preset temperature (T2) from the current temperature (T1) is equal to a first error value (C1), the controller keeps the location of the first slide valve (41), when the value acquired by subtracting the preset temperature (T2) from the current temperature (T1) is greater than the first error value (C1), the controller controls the first slide valve (41) to perform a loading action, the loading action is that the first slide valve (41) moves towards the suction end (211), when the value acquired by subtracting the preset temperature (T2) from the current temperature (T1) is smaller than the first error value (C1), the controller controls the first slide valve (41) to perform an unloading action, the unloading action is that the first slide valve (41) moves towards the discharge end (212).

15. The operation method according to claim 12, wherein in the f), the pair of the first screw rods (21) comprise a suction end (211) and a discharge end (212), when the two-stage refrigerant compressor is operated for heating and the value acquired by subtracting the preset temperature (T2) from the current temperature (T1) is equal to a first error value (C1), the controller keeps the location of the first slide valve (41), when the value acquired by subtracting the preset temperature (T2) from the current temperature (T1) is smaller than the first error value (C1), the controller controls the first slide valve (41) to perform a loading action, the loading action is that the first slide valve (41) moves towards the suction end (211), when the value acquired by subtracting the preset temperature (T2) from the current temperature (T1) is greater than the first error value (C1), the controller controls the first slide valve (41) to perform a unloading action, the unloading action is that the first slide valve (41) moves towards the discharge end (212).

16. The operation method according to claim 12, wherein in the g), when the value acquired by subtracting the set middle pressure (P2) from the current middle pressure (P1) is equal to a second error value (C2), the controller keeps the rotating speed of the second motor (32), when the value acquired by subtracting the set middle pressure (P2) from the current middle pressure (P1) is greater than the second error value (C2), the controller increases the rotating speed of the second motor (32), when the value acquired by subtracting the set middle pressure (P2) from the current middle pressure (P1) is smaller than the second error value (C2), the controller decreases the rotating speed of the second motor (32).

17. The operation method according to claim 12, wherein in the h), when the value acquired by dividing the low pressure specific volume (V1) by the middle pressure specific volume (V2) is equal to a third error value (C3), the controller keeps the location of the first slide valve (41), when the value acquired by dividing the low pressure specific volume (V1) by the middle pressure specific volume (V2) is greater than or smaller than the third error value (C3), the controller adjusts the location of the first slide valve (41), when the value acquired by dividing the middle pressure specific volume (V2) by the high pressure specific volume (V3) is equal to a fourth error value (C4), the controller keeps the location of the second slide valve (42), when the value acquired by dividing the middle pressure specific volume (V2) by the high pressure specific volume (V3) is greater than or smaller than the fourth error value (C4), the controller adjusts the location of the second slide valve (42).

* * * * *